United States Patent [19]

Matsuda et al.

[11] Patent Number: 4,902,669

[45] Date of Patent: Feb. 20, 1990

[54] THERMAL DYE TRANSFER PRINTING SYSTEMS, THERMAL PRINTING SHEETS, AND DYE RECEIVING SHEETS

[75] Inventors: Hiromu Matsuda, Osaka; Nobuyoshi Taguchi; Akihiro Imai, both of Ikoma; Keiichi Yubakami, Osaka, all of Japan

[73] Assignee: Matsushita Electric Industrial Co., Ltd., Osaka, Japan

[21] Appl. No.: 889,076

[22] Filed: Jul. 24, 1986

[30] Foreign Application Priority Data

Jul. 24, 1985 [JP] Japan ..... 60-163411
Jul. 24, 1985 [JP] Japan ..... 60-163413
Jul. 24, 1985 [JP] Japan ..... 60-163414
Jul. 24, 1985 [JP] Japan ..... 60-163415

[51] Int. Cl.[4] ..... B41M 5/035; B41M 5/26

[52] U.S. Cl. ..... 503/227; 8/471; 428/195; 428/913; 428/914

[58] Field of Search ..... 8/470, 471; 428/195, 428/206, 207, 323, 913, 914; 503/227

[56] References Cited

U.S. PATENT DOCUMENTS 4,474,859 10/1984 Oshima et al. ..... 503/227
4,490,434 12/1984 Oshima et al. ..... 503/227
4,541,830 9/1985 Hotta et al. ..... 428/913
4,555,427 11/1985 Kawasaki et al. ..... 428/913

FOREIGN PATENT DOCUMENTS 57-107885 7/1982 Japan ..... 503/227
58-148794 9/1983 Japan ..... 503/227
59-88981 5/1984 Japan ..... 503/227

*Primary Examiner*—Bruce H. Hess
*Attorney, Agent, or Firm*—Lowe, Price, LeBlanc, Becker & Shur

[57] ABSTRACT

A thermal transfer printing system comprising a dye transfer sheet having a dye carrier layer containing at least one sublimable dye and a dye acceptor sheet having a dye-receiving layer with good affinity for the sublimable dye. The two sheets are arranged during printing operations in such a way that they are facing through a slippage means which is in the form of a layer or particles of lubricating or thermally releasable materials. This system is adapted for a printing process in which a relative speed of the dye transfer sheet to a thermal printing head is smaller than a relative speed of the dye acceptor sheet under which the dye transfer sheet is heated in an imagewise pattern to permit the sublimable dye to deposit on the dye-receiving layer according to the imagewise pattern. The dye transfer sheet and the dye acceptor sheet most suitable for use in the system are also described.

2 Claims, 7 Drawing Sheets

THERMAL DYE TRANSFER PRINTING SYSTEMS, THERMAL PRINTING SHEETS, AND DYE RECEIVING SHEETS

BACKGROUND OF THE INVENTION

1. Field of the Invention

This invention relates to thermal transfer printing and more particularly, to a thermal dye transfer printing system, and also to thermal printing sheets and dye-receiving sheets which are most suitable for the transfer printing system to obtain full color hard copies of a high quality at low costs.

2. Description of the Prior Art

Several thermal transfer printing methods are known in which a half-tone image of a high quality can be obtained using an ink carrier sheet in an efficient manner. For instance, there has been proposed a method, for example, in Japanese Laid-open patent application No. 59-129196. In the method, a thermal transfer ink carrier film (which may be hereinafter referred to simply as transfer sheet) having a dye carrier layer, in which a thermally fusible ink is impregnated in a porous network structure, is fed at a speed lower than a speed of a printing paper (hereinafter referred to as dye or image acceptor sheet) on which the ink is transferred in an imagewise pattern. Another method has been also proposed, for example, in Collected Papers of the First Symposium on Non-impact Printing Techniques, "Characteristic Properties of Transfer Reaction-type Thermal Printing Papers", by Kubo et al, p. 39, 1984. In the method, a transfer sheet having a dye carrier layer mainly composed of leuco dyes is fed at a speed lower than a speed of a dye acceptor sheet which has a dye-receiving layer mainly composed of color developers capable of developing a color by coupling with the leuco dye on melting. An imagewise pattern is printed on the dye acceptor sheet by means of a thermal printing head.

Both methods described above utilized a relative speed system in which the feeding speed of the transfer sheet relative to the thermal printing head is lower than a feeding speed of the dye acceptor sheet relative to the thermal printing head, thereby ensuring effective utilization of the transfer sheet. When the feeding speed of the dye acceptor sheet is taken as v, the speed of the transfer sheet is determined as $v/n$ in which $n>1$. This relative speed system is advantageous over systems, in which the dye transfer sheet is repeatedly used for printing, in that because a fresh portion of the dye carrier layer is invariably in a printing zone, a variability in amount of a remaining dye in the printing zone during the printing process can be more reduced than in the latter system.

In these known methods, the dye carrier layer or both the dye carrier layer and the dye-receiving layer melt on printing, by which lubricity is imparted to the thermal transfer system. However, these methods are disadvantageous in that a picture element is apt to blur and an amount of a transferred dye does not become uniform owing to the difficulty in uniform contact between the transfer sheet and the dye acceptor sheet. As a result, a stable half tone cannot necessarily be reproduced without formation of an image of a smooth half tone.

On the other hand, a thermal transfer printing system using sublimable dyes is known, which ensures reproduction of a stable and smooth half-tone image of a high quality. This type of transfer sheet system using sublimable dyes has been proposed, for example, in Japanese Laid-open patent application No. 59-88981. The transfer sheet has, on a substrate, a dye carrier layer of a dispersion of a sublimable dye and non-sublimable particles in a binder resin. However, because the non-sublimable particles are not lubricating in nature, the transfer sheet will stick with an image acceptor sheet when they are fed at different relative speeds or will bring about an excessive frictional force on contact with the image acceptor sheet, thereby causing the sheets to travel unstably and the surface of the image acceptor sheet to be damaged.

Image acceptor sheets for use in the above type of thermal transfer printing system using sublimable dyes are also described, for example, in Japanese Laid-open patent application Nos. 57-107885 and 58-148794. These image acceptor sheets include a dye carrier layer containing a saturated polyester resin with or without fine powder of silica. However, this type of image acceptor sheet is not satisfactory for printing by feeding the transfer sheet and the acceptor sheet at different relative speeds, because the acceptor sheet is relatively poor with respect to the heat resistance, lubricity and smoothness. As a result, sticking or an excess of friction takes place, thus causing the sheets not to travel smoothly or deteriorate in image quality.

SUMMARY OF THE INVENTION

It is accordingly an object of the invention to provide a thermal transfer printing system in which a transfer sheet and an image acceptor sheet are fed at different relative speeds without involving the drawbacks of the prior art.

It is another object of the invention to provide a thermal transfer printing system from which full color hard copies can be obtained at low costs.

It is a further object of the invention to provide a dye transfer sheet using a sublimable dye and an image acceptor sheet which are useful for carrying out the thermal transfer printing.

According to the invention, there is provided a thermal printing system which comprises a dye transfer sheet, which has a thin substrate and a dye carrier layer formed on the substrate and comprising a mixture of at least one sublimable dye and a binder, and an image or dye acceptor sheet having on a substrate a dye-receiving layer capable of receiving the sublimable dye sublimating on heating of the dye transfer sheet and which is adapted for a printing process in which the transfer sheet is fed at a relative speed to a thermal printing head lower than a relative speed of the image acceptor sheet. The transfer sheet and the image or dye acceptor layer are arranged to slip without sticking. To this end, the transfer sheet and the dye acceptor sheet are facing through a slippage means. This means may be in the form of particles, spheres or a layer made of a lubricating or thermally releasable material. Alternatively, the dye-receiving layer may be made of a lubricating polymer resin or a cured resin comprising a liquid lubricant. In this case, the dye-receiving layer serves for reception of a sublimating dye and also as a slippage means. With the particles or spheres, part or all of the particles or spheres should be uniformly dispersed in the dye carrier layer as projecting from the surface level of the dye carrier layer. Because of the presence of the slippage means between the transfer sheet and the image acceptor sheet, both sheets are suitably fed at different relative speeds without sticking. When the transfer sheet is heated in an imagewise pattern by means of a heating means such as a thermal head or a laser beam, the sublimable dye sublimates and deposits on the image acceptor sheet to form an image thereon. Alternatively, imagewise heating may be effected by application of an electric current to the dye transfer sheet having as is known in the art.

The transfer sheet most suitable for the printing system of the invention should comprise, on a substrate, a dye transfer layer containing at least one sublimable dye, lubricating or thermally releasable solid particles and a binder for the dye and the particles. The lubricating or thermally releasable solid particles are dispersed in the binder as projecting from a surface level of the dye transfer layer. On the other hand, the dye acceptor sheet most suitable for the purpose of the invention should comprise a thin substrate, a white opacifying layer having a smooth surface and formed on one side of the substrate, and a dye-receiving layer formed on on the other side of the substrate and made of a resin having a high heat resistance. The dye-receiving layer may further comprise a lubricating or thermally releasable material to allow easy slippage.

Figure 5:
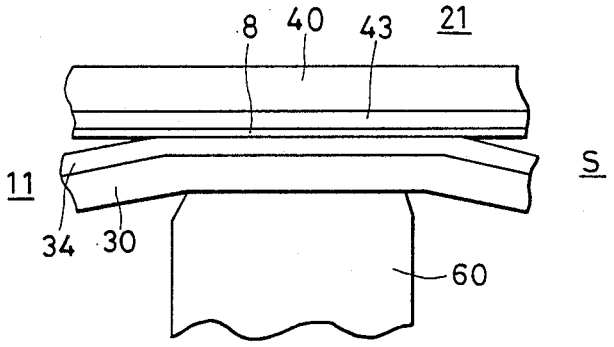
Figure 8:
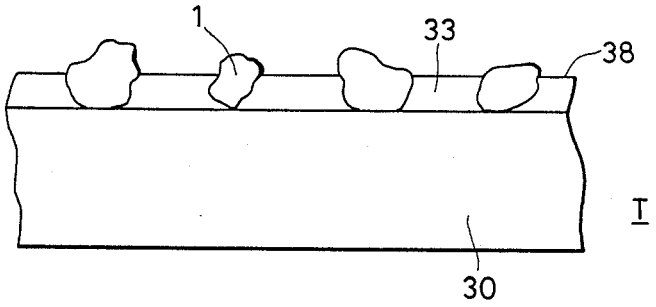
Figure 9:
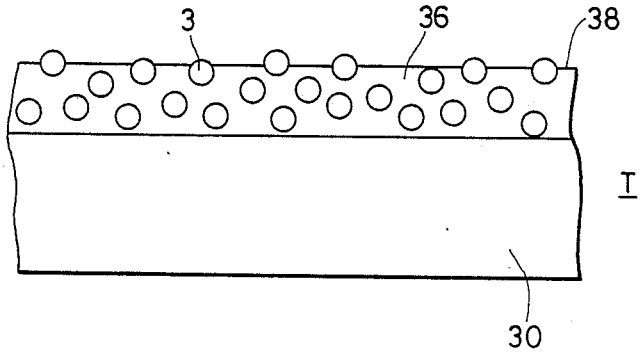
Figure 10:
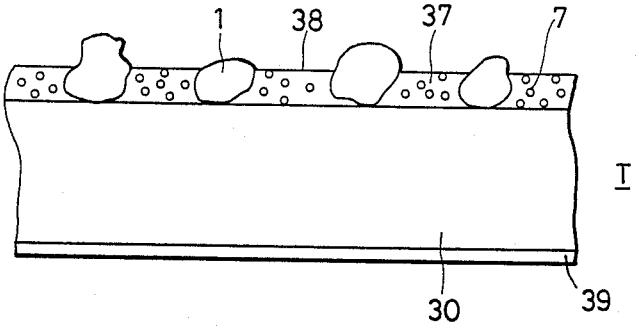
Figure 11:
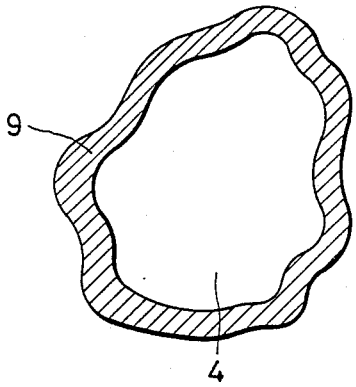
Figure 12:
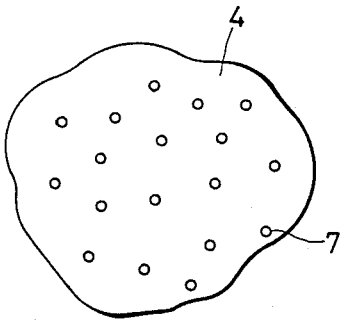
Figure 13:
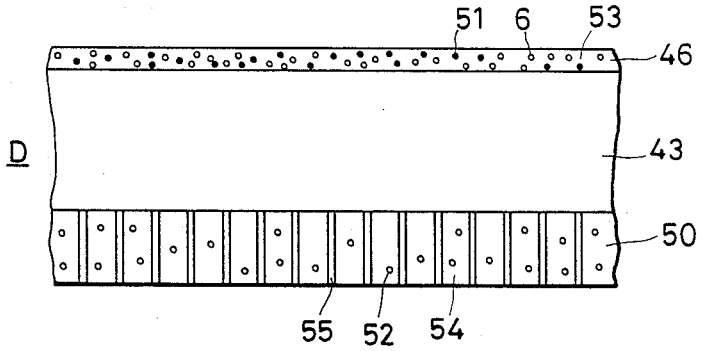
Figure 14:
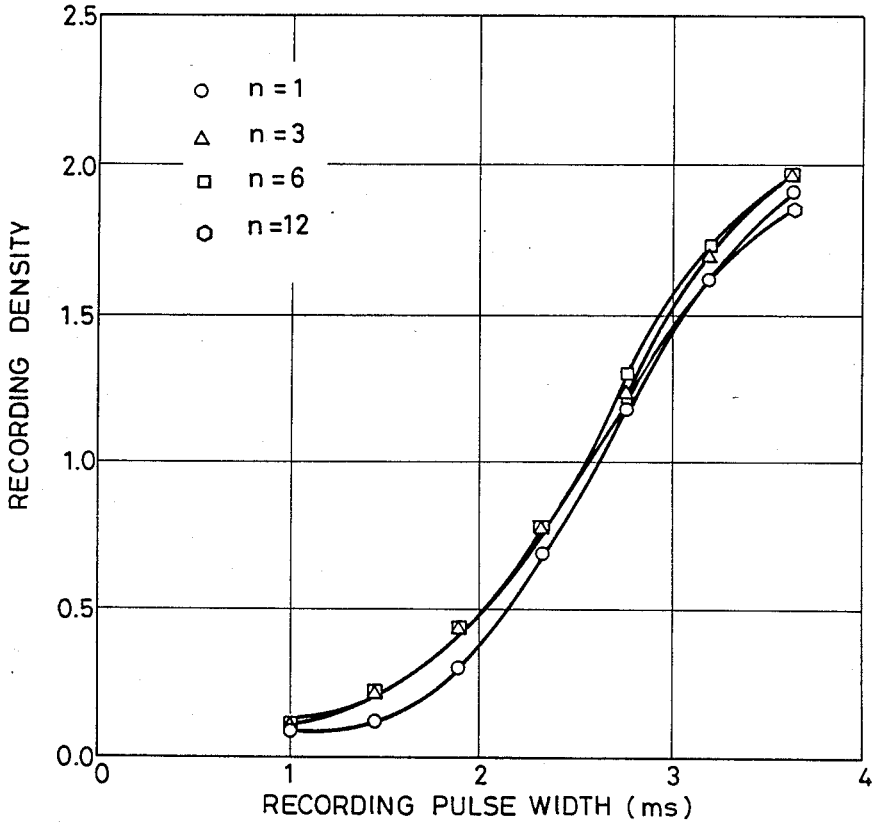

FIGS. *7a* and *7b* are schematic illustrative views in which a thermal printing system of FIG. 5 is used to illustrate the principle of the thermal printing according to the invention;

FIG. 8 is a schematic illustrative side view of a dye transfer sheet according to the invention;

FIGS. 9 and 10 are similar to FIG. 8 but illustrate different types of dye transfer sheets according to the invention;

FIGS. 11 and 12 are, respectively, illustrative views of lubricating particles used in the dye transfer sheets of the present invention;

FIG. 13 is a schematic illustrative view of a dye acceptor sheet according to the invention; and FIG. 14 is a graphical representation of a recording density in relation to variation in a recording pulse width for different feeding speeds of a dye transfer sheet relative to an image acceptor sheet.

DETAILED DESCRIPTION AND EMBODIMENTS OF THE INVENTION

The printing system of the present invention comprises a dye transfer sheet and a dye acceptor sheet. The dye transfer sheet has a dye carrier layer. The dye acceptor sheet has a dye-receiving layer which is in face-to-face relation with the dye carrier layer through a slippage means. The slippage means may be particles contained in the dye carrier layer as projecting from a surface level of the dye carrier layer. The particles should be lubricating in nature, but the particles may be in the form of spheres made of non-lubricating materials. Preferably, these particles have a layer of a lubricating material or disperse a lubricating material therein in order to facilitate the smooth printing operation at different relative speeds of the dye transfer sheet and the dye acceptor sheet.

Another slippage means may be a lubricating layer formed on the dye-receiving layer. The lubricating layer may be made of lubricating resins such as various silicone resins and fluorine resins. Alternatively, the lubricating layer may be made of a lubricating resin composition comprising a plastic resin and a liquid lubricant contained in an amount of 0.01 to 20 wt % of the resin. Preferably, the plastic resin should comprise not less than 50 wt % of a curable resin.

If the dye-receiving layer is formed of a resin composition comprising a cured resin in an amount sufficient to impart good lubricity and a heat resistance to the layer, such layer may also serve as the slippage means. In this case, it is preferred that a liquid lubricant is added in an amount of from 0.01 to 20 wt % of the resin composition.

Most preferably, the dye transfer sheet containing particles projecting from the surface level of the dye carrier layer and the dye acceptor sheet having a lubricating layer on the dye-receiving layer or a lubricating dye-receiving layer are used in combination.

The printing system of the invention is now described with reference to the accompanying drawings, in which like reference numerals indicate like parts or members.

Figure 1:
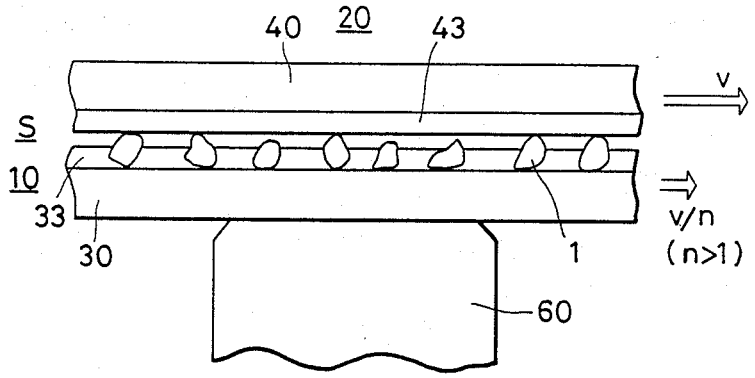
FIG. 1 is a schematic illustrative side view of a printing system according to one embodiment of the invention.

FIG. 1 schematically shows one embodiment according to the system of the invention. In the figure, there is shown a thermal transfer printing system S which includes a dye transfer sheet 10 and a dye acceptor sheet 20. The transfer sheet 10 has a sheet substrate 30 and a dye carrier layer 33 formed on the substrate 30. The dye carrier layer 33 is made of a dispersion of lubricating or thermally releasable particles 1 (hereinafter referred to simply as lubricating particles) and at least one sublimable dye in a resin binder. The dye carrier layer 33 has the particles 1 in such a way that part or substantially all of the particles 1 project from a surface level of the dye carrier layer 33. The particles 1 may have a size larger than a thickness of the dye carrier layer 33 or may have a size smaller than the thickness provided that part of the particles project from the surface level.

The dye acceptor sheet 20 has a sheet substrate 40 and a dye-receiving layer 43 comprising at least a material having high affinity for the sublimable dye and thus capable of receiving the dye. The transfer sheet 10 and the acceptor sheet 20 are so arranged that the dye carrier layer 33 and the dye-receiving layer 43 are facing each other through the lubricating particles as shown. Reference numeral 60 indicates a thermal printing head.

In operation, while the image acceptor sheet 29 is fed at a speed, v, relative to the thermal printing head 60, the relative speed of the transfer sheet 10 to the thermal printing head 60 is determined to be v/n in which $n > 1$. The transfer sheet 10 is heated in an imagewise pattern by means of the thermal printing head 60 from a side opposite to the dye carrier layer 33. The dye sublimating from the layer 33 is deposited on the image acceptor sheet 20 in the imagewise pattern.

When the feeding speed of the transfer sheet 10 relative to the thermal printing head 60 is 1/n of the feeding speed of the image acceptor sheet 20 relative to the thermal printing head 60, the consumption of the transfer sheet 10 is 1/n times the consumption of the image acceptor sheet 20. This is very advantageous from the standpoint of economy. In this embodiment, the lubricating particles 1 are dispersed in the layer 33 as projecting from a surface level of the layer 33. As a result, the thermal transfer printing suitably proceeds without sticking while permitting slippage between the sheets 10 and 20 owing to the presence of the lubricating particles serving as a slippage means.

The printing system according to the above embodiment is described in more detail with respect to constituent materials. It will be noted that the respective constituent materials of this embodiment are also usable in other embodiments described hereinafter unless otherwise described.

The substrates used for the transfer sheet in the embodiment are in the form of sheets, films and the like and generally have a thickness of from 3 to 15 micrometers. The materials for the substrate are not critically limited. Examples of the materials include polyesters such as polyethylene terephthalate, polyethylene naphthalate, polycarbonates and the like, polyamides, cellulose derivatives such as acetyl cellulose, polyimides, polyamideimides, polyether imides and the like. The substrate particularly suitable for the dye transfer sheet which directly contacts the thermal printing head should be a heat-resistant and lubricating layer. For this purpose, a back cost layer having a high heat resistance and good lubricity may be provided on the substrate as will be described with reference to FIGS. 3 and 4.

The sublimable dyes used in the dye carrier layer are any known dyes including, for example, disperse dyes, basic dyes, dye formers of basic dyes and the like. These dyes are well known in the art and are not specifically mentioned herein. In order to obtain full color hard copies, dyes of magenta, cyan and yellow in color are incorporated in the dye carrier layer.

The resin binders for the dye carrier layer include polysulfones, polycarbonates, polyphenylene oxide resins, cellulose derivatives and other various resins.

The substrates for the dye acceptor sheet are in the form of a sheet or film. The sheets or films may be transparent and include those of polyesters and the like. The sheets or films may be white in color and include, for example, synthetic papers based on polyesters and polypropylene, coated papers, ordinary papers and the like.

The dye-receiving layer is formed of various resins and should have high affinity for sublimable dyes and a high heat resistance. Examples of the resins include thermoplastic resins such as polyesters, polyamides, acrylic resins, acetate resins and curable resins such as various epoxy resins, urethane resins, silicone resins, phenolic resins, xylene resins, urea resins, melamine resins, unsaturated polyester resins, alkyd resins, furan resins, oligoacrylates and the like. Of these, cured products by application of heat, light, UV rays and electron beams are preferred in view of the high dye receptivity and heat resistance.

The slippage means in the form of projections functions also as a kind of spacer for the dye transfer sheet and the dye acceptor sheet and is made, for example, of lubricating or thermally releasable materials.

For this purpose, solid particulate lubricants are used and include, for example, graphite, molybdenum disulfide, tungsten disulfide, boron nitride, lead oxide, zinc oxide, gold, lead, zinc, molybdenum selenide, tungsten selenide, niobium selenide, talc, mica, fluorocarbon resins such as polyethylene tetrafluoride, polyamides, polyacetals, melamine resins, urea resins, guanamine resins, cellulose derivatives, starch and derivatives thereof and the like. These solid materials may be used singly or in combination. Of these, graphite, $MoS_2$, talc and fluorocarbon resins such as polyethylene tratrafluoride are preferred. The particles are generally used at a ratio by volume, to the binder, of 10 to 200:100 in order to ensure the projections.

The particles may be in the form of spheres. In this case, it is not essential that the spherical particles be formed of the above-indicated solid particulate lubricants, but the spheres may be made of various materials because the spherical shape is lubricating by itself as will be described with reference to FIGS. 3 and 4.

Figure 2:
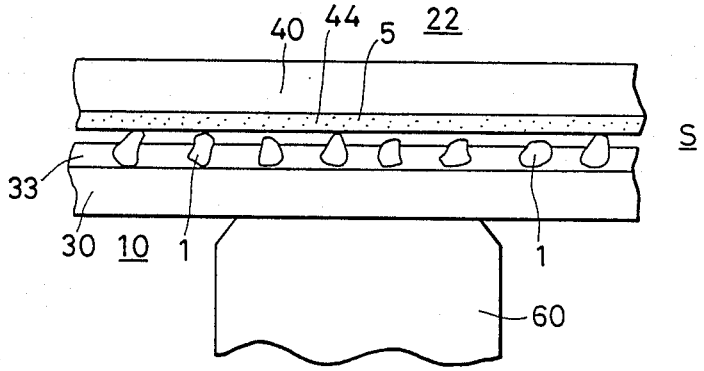
FIG. 2 is similar to FIG. 1 but illustrates another embodiment of the invention.

FIG. 2 illustrates another embodiment of the invention in which the transfer sheet 10 has a construction as shown in FIG. 1. In this embodiment, the image or dye acceptor sheet 22 has the substrate 40 on which a dye carrier layer 44 which is made of a dispersion of a lubricating material 5 in a dye-receiving material. The difference between the acceptor sheet 22 and the acceptor sheet 20 of the first embodiment resides in the presence or absence of the lubricating material 5. This lubricating material dispersed in the layer 44 permits better slippage between the sheets 22 and 10.

The lubricating material 5 may be made of the solid lubricating materials defined before, and may further include other lubricating materials including liquid lubricants. Specific examples of the lubricating materials include petroleum lubricants such as liquid paraffin, synthetic lubricants such as hydrogenated hydrocarbons, diester oils, silicone oils, fluorinated silicone oils and the like, various modified silicone oils such as epoxy-modified oils, amino-modified oils, alkyl-modified oils, polyether-modified oils and the like, silicone-base lubricants such as copolymers of organic compounds, such as polyoxyalkylene glycols, and silicones, various fluorine surface active agents such as fluoroalkyl compounds, fluorine lubricants such as trifluorochloroethylene oligomers, waxes such as paraffin wax, polyethylene wax and the like, higher fatty alcohols, higher alcohols, higher fatty amides, higher fatty acid esters, higher fatty acid salts, and the like. Of these, materials, which are liquid at normal temperatures, are preferably used and include, for example, dimethylpolysiloxane, methylphenylpolysiloxane, methylhydrogenpolysiloxane, fluorinated silicone oils, various modified silicone oils such as epoxy modified, alkyl-modified, amino-modified, carboxyl-modified, alcohol-modified, polyether-modified, alkyl-aralkyl-polyether-modified, and epoxy-polyether-modified silicone oils, silicone lubricants such as copolymers of organic compounds such as polyoxyalkylene glycols and silicones, organic metal salts, various fluorine surface active agents such as fluoroalkyl compounds, fluorine lubricants such as trifluorochloroethylene, alkylbenzenes, polybutene, alkylnaphthalenes, alkyldiphenylethane, phosphoric esters, polyalkylene glycols, saturated hydrocarbons, animal and plant oils, mineral oils and the like. These liquid materials may be used singly or in combination. The amounts of these liquid lubricants may vary depending on the type of liquid lubricant and the purpose.

Figure 3:
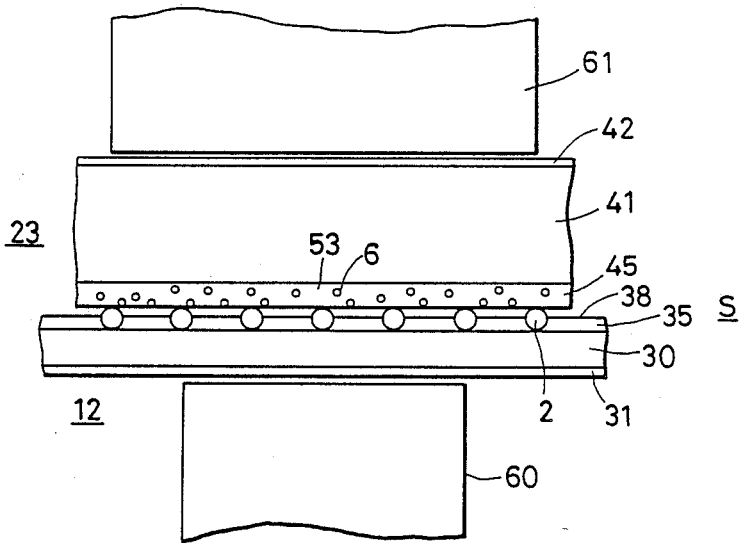
FIGS. 3 through 6 are, respectively, similar to FIG. 1 but illustrate further embodiments of the invention.
Figure 4:
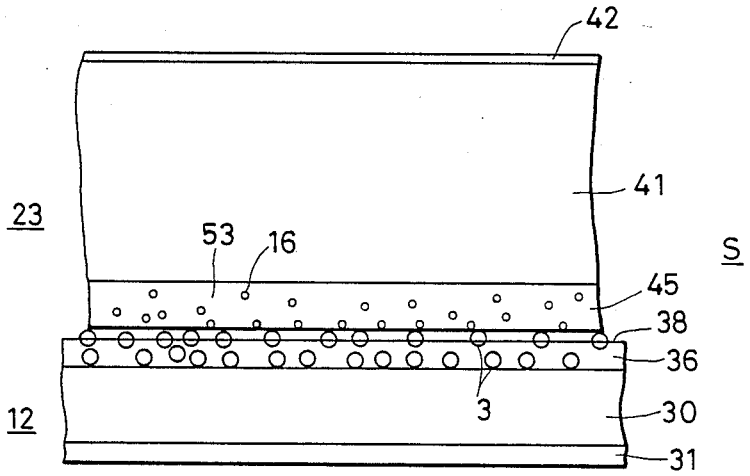

FIGS. 3 and 4 schematically show thermal transfer printing systems according to further embodiments of the invention. In FIG. 3, there is shown a thermal printing system S which includes a transfer sheet 12 and a dye or image acceptor sheet 23. The transfer sheet 12 is similar to the transfer sheet 10 of FIG. 1 except that a lubricating heat-resistant back coat layer 31 is formed on one side which contacts the thermal printing head 60. In this embodiment, the particles are depicted in the form of a sphere. The layer 31 is made of a resin composition which comprises a curable resin, fine inorganic particles and a liquid lubricant. The back coat layer will be more particularly described with reference to FIG. 10.

On the other side of the substrate 30 is formed a dye carrier layer 35 containing heat-resistant spherical particles 2 projecting from a surface level 38 of the dye carrier layer 35. According to the embodiment of FIG. 3, the spherical particles 2 have a diameter larger than a thickness of the dye carrier layer 35, so that substantially all the particles 2 project from the surface level 38.

The image acceptor sheet 23 of FIG. 3 includes a smooth, heat-resistant substrate 41 made, for example, of a polyester film, which may have a white opacifying layer 42 on one side thereof. On the other side is formed a lubricating, heat-resistant dye-receiving layer 45 comprising a cured resin 53. Since the spherical particles 6 are used, the layer 45 may be made of a cured resin composition comprising not less than 50 wt% of a curable resin in combination with other types of resin binder. However, it is preferred that a liquid lubricant is contained in the layer 45 in order to facilitate the slippage between the transfer sheet 12 and the dye acceptor sheet 23. The liquid lubricant may be contained in an amount of from 0.01 to 20 wt% of the resin composition.

In operation, the transfer sheet 12 and the image acceptor sheet 23 are pressed between the thermal printing head 60 and a platen 61 in such a way that the spherical particles 2 contact the dye-accepting layer 45. Since a lubricating material is contained and the particles are spherical in shape, the two sheets can be fed smoothly under different relative speed conditions.

FIG. 4 is similar to FIG. 3 except that the spherical particles 3 have a smaller diameter than the spherical particles 2, i.e. the diameter of the spherical particles 3 is smaller than the thickness of a dye carrier layer 36 of FIG. 3. In the thermal transfer printing system of FIG. 3, substantially all the particles 2 project from the surface level 8 since the diameter of the particles 2 is larger than the thickness of the dye carrier layer 35. With the system of FIG. 4, part of the particles 3 project from the surface level 38.

The spherical particles used in the embodiments with reference to FIGS. 3 and 4 are not limited to those indicated with respect to the lubricating particles and may be made of various materials. The materials include, for example, metals, metal oxides, metal sulfides, metal carbides, graphite, carbon black, silicon carbide, minerals, inorganic salts, organic pigments, polymer compositions and the like. Specific examples of the materials having a high effect are as follows.

Metals: aluminium, silicon, germanium, tin, copper, zinc, silver, iron, cobalt, nickel, chromium, and alloys composed mainly of the metals indicated above.

Metal oxides: alumina, berylium oxide, magnesium oxide, cuprous oxide, zinc oxide, indium oxide, tin oxide, titanium oxide, silicon oxide, iron oxide, cobalt oxide, nickel oxide, manganese oxide, tantalum oxide, vanadium oxide, tungsten oxide, molybdenum oxide, and these oxides doped with impurities.

Metal sulfides: copper sulfide, zinc sulfide, tin sulfide and molybdenum oxide.

Minerals: soil minerals, lime minerals, strontium mineral, barium minerals, zirconium minerals, titanium minerals, tin minerals, phosphorus minerals, aluminium minerals including agalmatolite, kaolin and clay, and silicon minerals including quartz, mica, talc, zeolite, diatomaceous earth and the like.

Inorganic salts: carbonates or sulfates of alkaline earth metals such as magnesium carbonate, calcium carbonate, strontium carbonate, barium carbonate, magnesium sulfate, calcium sulfate, strontium sulfate, barium sulfate and the like, salts composed mainly of metal silicates.

Polymer resins and compositions: phenolic resins, melamine resins, urethane resins, epoxy resins, silicone resins, urea resins, dially phthalate resins, alkyd resins, acetal resins, acrylic resins, methacrylic resins, polyester resins, cellulose derivatives, starch and derivatives thereof, polyvinyl chlorides, polyvinylidene chlorides, chlorinated polyethylene, fluorine resins, polyethylene, polypropylene, polystyrene, polydivinylbenzene, polyvinyl acetal, polyamides, polyvinyl alcohol, polycarbonates, polysulfones, polyether sulfones, polyphenylene oxides, polyphenylene sulfides, polyether ether ketones, polyaminobismaleides, polyarylates, polyethylene terephthalate, polybutylene terephthalate, polyethylene naphthalate, polyimides, polyamideimides, polyacrylonitrile, benzoguanamine resins, and compositions comprising these resins.

Of these, curable resins and glass materials are preferred.

These materials are used in the form of spherical particles having from 0.1 to 10 micrometers. This is because the dye carrier layer is usually formed in a thickness of from 0.1 to 5 micrometers.

FIG. 5 illustrates a printing system according to another embodiment of the invention in which a transfer sheet 11 and an image acceptor sheet 21 are similar to FIG. 1 except that the transfer sheet 11 has a dye carrier layer 34 made of at least one sublimable dye and a resin binder without the lubricating particles 1 in FIG. 1. In order to allow slippage between the two sheets, the image acceptor sheet 21 has, on the substrate 40, the dye-receiving layer 43 of a material capable of receiving a dye thereon and a very thin heat-resistant resin layer 8 having lubricity or thermal releasability as shown. This layer 8 serves as a slippage means in this embodiment. Similar to FIG. 1, the dye carrier layer 34 and the dye-receiving layer 43 are facing each other in practical applications. The transfer sheet is heated in an imagewise pattern by means of the head 60 from the back side of the dye carrier layer 34. Since the very thin lubricating resin layer 8 is formed, the dye sublimating through the layer 8 on heating can deposit on the sheet 21. In general, the thickness of the layer 8 is in the range of from 0.05 to 3 micrometers and the layer 8 is made of a lubricating resin or its composition. The lubricating resin may include various types of silicone resins, fluorocarbon resins and the like. Alternatively, curable resin compositions may be used to form the lubricating layer 8. The curable resins used for this purpose include epoxy resins, urethane resins, silicone resins, phenolic resins, xylene resins, urea resins, melamine resins, unsaturated polyester resins, alkyd resins, furan resins, oligoacrylates and the like. The curable resin composition generally comprise not less than 50 wt% of the curable resin. The balance may be thermoplastic resins indicated hereinbefore. Preferably, a liquid lubricant is added to the resin composition in an amount of from 0.01 to 20 wt% of the resin.

If the dye-receiving layer 43 is made of a cured product of a curable resin composition, the lubricating layer 8 in FIG. 5 may not be necessary. This cured resin layer serves as both a dye-receiving layer and a lubricating layer.

Figure 6:
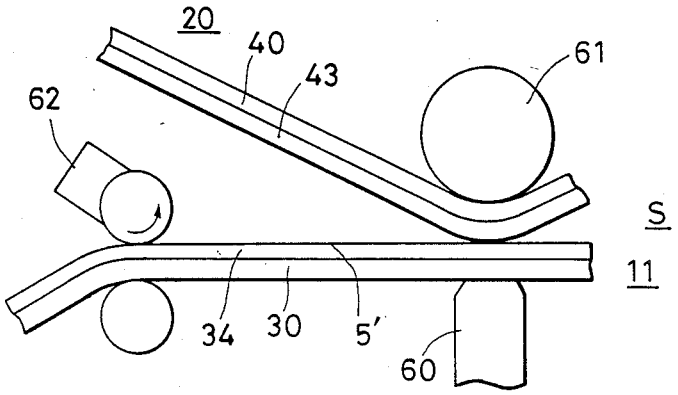
Figure 7A:
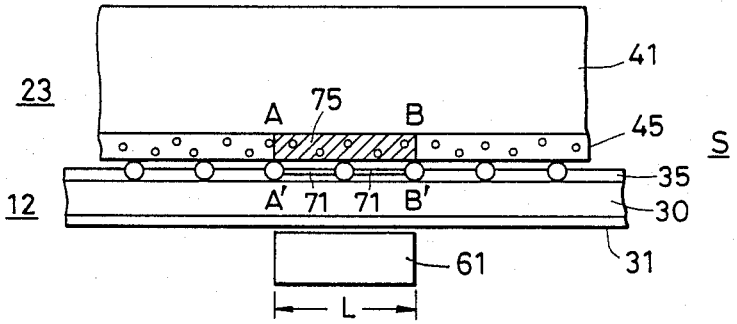
Figure 7B:
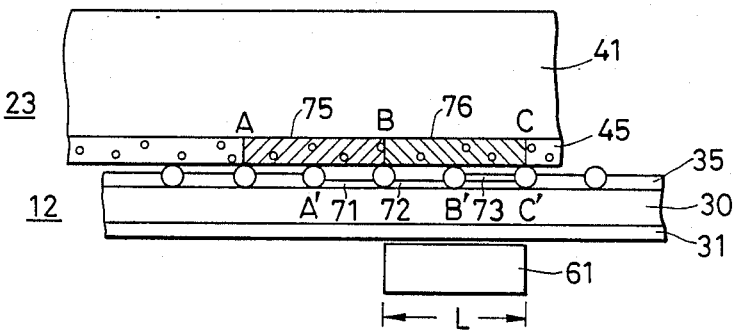

FIG. 6 shows a still further embodiment of the invention in which the transfer sheet 11 as shown in FIG. 5 is used and has the thin substrate 30 and the dye carrier layer 34 of a dispersion of at least a sublimable dye in a binder resin. The dye acceptor sheet 20 as shown in FIG. 1 is used in combination with the transfer sheet 11 in such a way that the dye carrier layer 34 and the dye-receiving layer 43 are facing each other at speeds of the sheets 20 and 11 of v and v/n (n>1) relative to the thermal printing head 60. In this system, the dye carrier layer 34 is coated, prior to printing, with a lubricating material 5 on the surface thereof by means of an applicator 62. Subsequently, the thermal printing is effected by heating the transfer sheet 11 by means of the thermal printing head 60 in a manner as described hereinbefore. Reference numeral 61 indicates a platen. The lubricant used may be in the form of a solution or dispersion of a lubricating material defined with respect to the foregoing embodiments.

In accordance with the invention, the manner of printing is not limited to a case where the transfer sheet is fed in the same direction as the dye acceptor sheet and also to a case where the thermal printing head is fixed in position. If desired, the transfer sheet and the dye acceptor sheet may be fed in opposite directions. The thermal printing head may be moved, not fixed in position.

In the system of the invention, it is essential that the dye transfer sheet 10, 11 or 12 be fed at a lower speed than the dye acceptor sheet 20, 21, 22 or 23. This mode of printing is more particularly described in FIGS. *7a* and *7b* using the printing system of FIG. 3.

FIG. *7a* shows a printing operation of the Lth line along a sub-scanning printing direction and FIG. *7b* shows an (L+1)th line. The head 61 has a sub-scanning length L of a heating element (not shown). The dye acceptor sheet 35 has a shaded portion 75 defined by A and B on which a dye is received by application of heat from the thermal printing head 61. For the dye reception of the shaded portion 75, the dye in portion 71, 72 of the dye carrier layer 35 defined by A' and B' in FIG. *7b* is consumed as shown. For a subsequent printing operation of the (L+1)th line, a fresh dye carrier portion 73 indicated by B' and C' in FIG. *7b* is invariably supplied, so that an image 76 having a good color density is formed on the dye-receiving layer 45.

The thermal transfer printing system of the invention has a number of advantages.

Since sublimable dyes in the dye carrier layer sublimate from the dye carrier layer and deposit on the dye-receiving layer of the dye acceptor sheet in the form of molecules according to a quantity of heat from the thermal printing head, good and smooth half-tone images of a high quality are reproduced. Thus, as is different from a case where a dye is migrated from a transfer sheet surface to a dye acceptor sheet surface in a melting state, the migration of a sublimable dye from the dye carrier layer to the dye-receiving layer is rarely influenced by the relative speed between the transfer sheet and the dye acceptor sheet.

The slippage means provided between the dye carrier layer and the dye-receiving layer can reduce a frictional force between the transfer sheet and the dye acceptor sheet when these sheets are fed at different speeds and subjected to printing with the thermal printing head. Especially, the slippage means can prevent sticking between the dye carrier layer and the dye-receiving layer as will be caused by an excessive friction at high temperatures. Thus, a stable operation of feeding the transfer sheet and the dye acceptor sheet at different speeds is ensured. For instance, in the embodiments of FIGS. 3 and 4 in which there are used the transfer sheet having projecting spherical particles in the dye carrier layer and the dye acceptor sheet having a heat-resistant, lubricating dye-receiving layer, the spherical particles alone are in contact at the tips thereof with the surface of the lubricating dye-receiving layer. In this condition, heat is applied to the dye carrier layer according to a recording signal from the head, by which a sublimable dye sublimates from the dye carrier layer and deposits on the dye-receiving layer to form an image.

In the practice of the invention, a sublimable dye alone is migrated from the transfer sheet to the dye acceptor sheet and thus, an absolute amount of the dye necessary for formation of an image is small. The dye carrier layer on the transfer sheet after the migration of the dye undergoes only a relatively small change.

The dye transfer sheet which is most suitable for use in the thermal transfer printing system of the invention is more particularly described.

Of the thermal transfer sheets and the dye acceptors sheets used in the embodiments of FIGS. 1 through 7, the transfer sheets as shown FIGS. 1, 3 and 4 are preferred. In FIG. 8, there is shown the transfer sheet T which is the same as the sheet 10 of FIG. 1, in which lubricating particles 1 are dispersed as projecting from the surface level 38 of the dye carrier layer 33. In FIG. 9, there is also shown the transfer sheet T corresponding to the transfer sheet 12 of FIG. 4 in which spherical particles having a diameter smaller than a thickness of the dye carrier layer 36 are included but the lubricating, heat-resistant layer 31 is not formed.

FIG. 10 shows a transfer sheet T according to a further embodiment of the invention. This transfer sheet S is similar to the sheet of FIG. 8 except that a dye carrier layer 37 is made of a dispersion of the lubricating particles 1 and a liquid or thermally melting lubricating material 7 in a resin binder and that a back coat layer 39 is provided. The particles 1 have sizes sufficient to projecting from the surface level of the dye carrier layer 37. Examples of the liquid lubricating materials are those indicated hereinbefore. Examples of the thermally melting lubricating materials include various modified silicone oils, silicone-base lubricant materials such as copolymers of organic compounds such as polyoxyalkylene glycols and silicones, fluorine lubricants such as oligomers of trifluorochloroethylene, paraffin wax, polyethylene waxes, higher fatty alcohols, higher alcohols, higher fatty acid amides, higher fatty acid esters, higher fatty acid salts and the like.

The back coat layer 39 is made of a cured resin composition having fine particles and a liquid lubricant so that the layer 39 is resistant to heat and allows smooth contact with a heating means.

Most preferably, the particles 1 or spheres 3 of the transfer sheet T according to the invention have lubricating materials on the surface or in the inside thereof. This is particularly described in FIGS. 11 and 12.

In FIG. 11, a particle 4 is covered with a lubricant layer 9 which is made of a lubricating or thermally releasable material. FIG. 12 shows a particle 4 having a liquid or thermally fusible lubricating material 7 dispersed therein.

Liquid or thermally fusible, lubricating or thermally releasable materials useful as the layer 7 or the dispersed material 7 are, for example, petroleum lubricants such as liquid paraffin, halogenated hydrocarbons, ester oils, silicone oils, fluorine silicone oils, various modified silicone oils such as epoxy-modified, amino-modified, alkyl-modified and polyether-modified silicone oils, silicone lubricants such as copolymers of organic compound such as polyoxyalkylene glycols and a silicones, various fluorine surface active agents such as fluoroalkyl compounds, fluorine lubricating materials such as oligomers of trifluorochloroethylene, waxes such as paraffin wax, polyethylene wax and the like, higher fatty alcohols, higher alcohols, higher fatty acid amides, higher fatty acid esters, higher fatty acid salts, and the like.

The particles or spheres are generally added to the layer at a ratio by weight, to a resin, of 10 to 200:100.

The dye acceptor sheet which is most suitably used in the thermal transfer printing system is described.

FIG. 13 schematically shows a dye acceptor sheet 24 which includes a substrate 43 such as a polymer film, and a white opacifying layer 50 formed on one side of the substrate 43 and made of a resin 54 and fine particles 52 having a size not larger than 1 micrometer. The opacifying layer 50 has fine pores 55.

On the other side of the substrate is formed a dye-receiving layer 46 which is made of a dispersion of a liquid lubricant 6 and heat-resistant fine particles 51 having a size below 1 micrometer in a cured resin product 53. This dye acceptor sheet is particularly suitable for smooth thermal printing operations.

The polymer film substrate 43 is a 10 to 100 micrometer thick film of various polymers such as polyesters, polypropylene, polyamides, polyimides, polystyrene, polyvinyl chloride, and the like.

The white opacifying layer 50 is generally formed in a thickness of from 10 to 30 micrometers. Examples of the resins for the layer 50 may be thermosetting or thermoplastic resins, of which thermoplastic resins are preferred. Examples of the thermoplastic resins include polyvinyl chloride, polyvinyl acetate, AS resins, ABS resins, polyesters, polystyrene, polyethylene, blends of acrylic and acetate resins, and copolymers of acrylic and acetate monomers. Opacifying fine particles 53 are, in most cases, inorganic fine particles having a size below 1 micrometer, such as $Al_2O_3$, $TiO_2$, $SiO_2$, $CaCO_3$ and the like.

If necessary, plasticizers and/or surface active agents may be added to the layer 50. The fine pores 55 are physically formed by evaporation of a solvent used in a coating paint along with the plasticizers and/or surface active agents.

The cured resin product 53 capable of receiving a sublimating dye is a cured product of polymers which are curable by application of heat, light and/or electron beams.

Curable materials include, for example, various epoxy resins, urethane resins, silicone resins, phenolic resins, xylene resins, urea resins, melamine resins, unsaturated polyester resins, alkyd resins, furan resins, oligoacrylates and the like. Of these, various epoxy resins and oligoacrylates which are curable with UV rays are preferred. Specific examples of the epoxy resins include aliphatic epoxy resins such as vinylcyclohexene dioxide, 3,4-epoxycyclohexylmethyl-3,4-epoxycyclohexane carboxylate and the like. Specific examples of the oligoacrylates include polyol acrylates, polyester acrylates, epoxy acrylates, urethane acrylates, silicone acrylates, polyacetal acrylates and the like.

The resins may be used in combination with reactive diluents such as tetrahydrofurfuryl acrylate, lauryl acrylate and the like.

The liquid lubricating material 6 is added in an amount of from 0.01 to 20 parts by weight per 100 parts by weight of the dye-receiving resin.

The heat-resistant fine particles 51 contained in the dye-receiving layer 46 have generally a size not larger than 1 micrometer, preferably not larger than 0.1 micrometer. The particles may be inorganic or organic.

Preferable examples of the fine particles are particles of kaolin, clay, zinc oxide, barium sulfate, alumina, aluminium hydroxide, titanium oxide, synthetic amorphous silica, magnesium carbonate, calcium carbonate, calcium silicate, aluminium silicate, magnesium silicate, carbon black, graphite, fluorocarbon resins, polytetrafluoroethylene and the like.

Synthetic amorphous silica includes anhydrous silica and hydrous silica. Useful anhydrous silica may be ultrafine particles prepared by a vapor phase method. This type of silica has been developed by Degsa Co., Ltd. of West Germany and is commercially available under the designation of Aerosil from Nippon Aerosil Co., Ltd. Likewise, ultrafine particles of aluminium oxide and titanium oxide prepared by vapor phase methods are known and available from Nippon Aerosil Co., Ltd.

Hyrous silica may be called white carbon and is commercially available from under the designations of "Carplex" from Shionogi Pharm. Co., Ltd., "Nipseal" from Nippon Silica Ind. Co., Ld., "Silton" from Mizusawa Chem. Ind. Co., Ltd., and "Fine Seal and Toku Seal" from Tokuyama Soda Co., Ltd.

Ultrafine particles of silica and/or alumina having a size not larger than 0.1 micrometer are preferably added in an amount of from 1 to 10 parts by weight per 100 parts by weight of the resin.

Since the dye acceptor sheet of the invention has the dye-receiving layer on ones side, which has a smooth surface, high heat resistance and good lubricity, and an opacifying layer on the other side, the sheet ensures a uniform contact with the dye transfer sheet and can prevent an excessive frictional force by sticking with the transfer sheet. A stable relative speed operation is possible without causing any significant damages on the dye carrier layer and the dye-receiving layer of the respective sheets. As a result, hard copies with half-tone images of a high quality can be formed reproducibly.

The present invention is more particularly described by way of examples. Comparative examples are also described. Examples 1–17 and Comparative Examples 1–6.

Dye transfer sheets were made using a sheet substrate of a 6 micrometer thick polyimide film. In all the dye transfer sheets, the polyimide film was coated on a back side thereof with a coating paint of a composition indicated in Table 1, followed by coating a paint for a dye carrier layer by means of a wire bar, dried with hot air, and cured by a high pressure mercury lamp.

TABLE 1

| | Ratio by Wt. |
|---|---|
| epoxy acrylate resin (viscosity: 150 poises) | 12 |
| neopentyl glycol diacrylate | 3 |
| 2-hydroxy-2-methylpropiophenone | 0.75 |
| white carbon (Carplex FPS-1) | 3.0 |
| silicone oil | 0.15 |
| surface active agent (L7500, by Nippon Unicar Co., Ltd.) | 0.3 |

TABLE 1-continued

| | Ratio by Wt. |
|---|---|
| ethyl acetate | 100 |

A sublimable dye of the following formula (I) was commonly used.

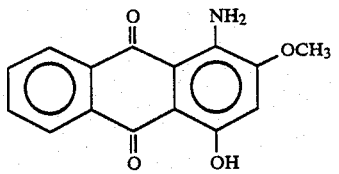

(I)

The dye carrier layers were formed by dissolving or dispersing particles and materials indicated in Table 2 in dichloromethane along with 4 parts by weight of polysulfone and 12 parts by weight of the sublimable dye and applying the respective paints on the substrate by means of a wire bar in an amount of about 0.3 g/m$^2$ as the dye (corresponding to a dye carrier layer thickness of about 1 micrometer), followed by drying to obtain transfer sheets.

TABLE 2

| Transfer Sheet | Particles or Lubricating Material | Parts by Weight |
|---|---|---|
| a | — | 0 |
| b | alumina abrasive (average size: 3 μm) | 8 |
| c | polyethylene tetrafluoride (average size: 7 μm) | 8 |
| d | molybdenum disulfide (average size: 0.4 μm) | 13 |
| e | fluorocarbon resin (average size: 4.7 μm) | 4 |
| f | melamine resin (average size: 5 μm, sphere in shape) | 8 |
| g | glass beads (average size: 5 μm, sphere in shape) | 8 |
| h | particles I (average size: 7 μm) | 8 |
| i | particles II (average size: 7 μm) | 8 |
| j | polyoxyalkylene/silicone copolymer | 0.5 |
| k | graphite (average size: 1 μm) | 4 |
| k' | graphite (average size: 1 μm) | 4 |
| | polyoxyalkylene/silicone copolymer | 0.2 |

The particles I and II in the above table were prepared as follows.

Particles I: 10 parts by weight of an epoxy resin (Epikote 828, Shell Inc.), 1 part by weight of triethylenetetramine serving as a curing agent, 0.5 parts by weight of polyoxyalkylene/silicone copolymer (L-7500, by Nippon Unicar Co., Ltd.), 3 parts by weight of silica (Aerosil R972, by Nippon Aerosil Co., Ltd.) and 100 parts by weight of methyl ethyl ketone were sufficiently dispersed to obtain a coating paint. Glass beads having an average size of 5 micrometers were coated with the paint by the use of a fluidized bed coating apparatus in a coating thickness of about 1 micrometer.

Particles II: 20 parts by weight of a melamine resin (Sumitex Resin M-3, by Sumitomo Chem. Co., Ltd.), 2 parts by weight of a curing agent (Sumitex Accelerator ACX, by Sumitomo Chem. Co., Ltd.), 1 part by weight of a silicone oil (L-45, Nippon Unicar Co., Ltd.) and 40 parts by weight of water were mixed and sufficiently agitated with a high speed agitator. The mixture was granulated in the form of spheres by means of a spray drying apparatus and cured in a thermostatic chamber at 120° C. for 2 hours. Thereafter, the granules were classified to obtain granules having an average size of about 7 micrometers.

The microscopic observation of a surface state of each dye carrier layer reveals that the transfer sheet a and j had a substantially flat surface, the transfer sheets d, k and k' had surfaces which were rendered significantly irregular, and the other transfer sheets had particles which largely projected from the surface level of the dye carrier layer.

The following four dye acceptor sheets were provided. Dye acceptor sheet A: a laminated polypropylene synthetic paper was provided as a substrate. Three coating paints were provided including coating paint 1 which was an aqueous dispersion of 20 vol.% of a polyester (commercial name: Vylonal MD 1200, by Toyobo Co., Ltd.), coating paint 2 which was an aqueous dispersion of 20 vol.% of polyethylene and coating paint 3 which was an aqueous dispersion of 20 vol.% of silica having an average size of 200 angstroms. The coating paints 1, 2 and 3 were mixed at ratios by weight of 1:1:2 and applied onto the synthetic paper to form a dye receiving layer in a thickness of about 5 micrometers. Dye acceptor sheet B: a polypropylene synthetic paper having a white opacifying layer was provided as a substrate. On the opacifying layer was applied a coating paint of 15 parts by weight of an aqueous dispersion of a polyester (Vylonal MD 1200, by Toyobo Co., Ltd.) and 30 parts by weight of water by means of a wire bar to form an about 5 micrometer thick layer as a first layer. A coating paint comprising 8 parts by weight of oligoester acrylate resin, 0.4 parts by weight of 2-hydroxy-2-methylpropiophenone and 50 parts by weight of ethyl acetate was applied onto the first layer, dried with hot air and cured with a high pressure mercury lamp to form an about 1.5 micrometer thick dye-receiving layer. Dye acceptor sheet C: an extruded white sheet of polyethylene terephthalate was provided as a substrate. A coating paint of 15 parts by weight of an aqueous dispersion of a polyester resin (Vylonal MD 1200) and 30 parts by weight of water was applied onto the white sheet to form a first layer having a thickness of an about 5 micrometers. Thereafter, a coating paint of 8 parts by weight of oligoester acrylate, 0.4 parts by weight of 2-hydroxy-2-methylpropiophenone, 0.2 parts by weight of polyoxyalkylene/silicone copolymer (L-7500, by Nippon Unicar Co., Ltd.) and 50 parts by weight of ethyl acetate was coated onto the first layer, dried with hot air and cured by means of a high pressure mercury lamp, thereby forming a second layer having a thickness of about 0.5 micrometers. Dye acceptor sheet D: a 50 micrometer thick polyethylene terephthalate film having a 30 micrometer thick white opacifying was provided. 100 parts by weight of oligoester acrylate resin (Aronix M-8030, by Toa Synthetic Science Ind Co., Ltd.), 5 parts by weight of 2-hydro-2-methyl-1-phenylpropan-1-one serving as a photopolymerization initiator for UV curing, 1 part by weight of a silicone oil, 0.5 parts by weight of a surface active agent (L 7500, by Nippon Unicar Co, Ltd.), and 500 parts by weight of toluene were mixed. The mixture was coated onto the film on the side free of the opacifying layer by means of a bar coater in an amount of 5 g/m$^2$ as solids, dried with hot air of 60° C. and cured by irradiation with a 1 KW high pressure mercury lamp to form a dye-receiving layer.

The transfer sheets and the dye acceptor sheets thus made were used for transfer printing under the following printing conditions to determine travelling properties and the quality of printed images.

Recording conditions:

Main and sub-scanning line density: 8 dots/mm

Recording speeds relative to a fixed thermal head:

Running speed of a dye acceptor sheet: 16 ms/line

Running speed of a dye transfer sheet: $\frac{1}{3}$ of the speed of the dye acceptor sheet in the same direction as the dye acceptor sheet.

Recording power: 17.5 W/mm$^2$

Recording pulse width: 0–3.6 ms.

The results are shown in Tables 3 and 4 below.

TABLE 3

| | Transfer Sheet | Acceptor Sheet | Travelling Property | Image Quality | Recording Density (magenta) |
|---|---|---|---|---|---|
| Comparative Example: | | | | | |
| 1 | a | A | very poor (sticking) | — | — |
| 2 | b | A | poor–very poor (sticking) | very poor (surface defects) | 1.65 |
| 3 | a | B | very poor (sticking) | — | — |
| 4 | b | B | poor (stick-slip) | very poor (surface defects) | 1.62 |
| 5 | b | C | poor (stick-slip) | poor–very poor (surface defects) | 1.60 |
| Example: | | | | | |
| 1 | a | C | good | good | 1.73 |
| 2 | j | B | good | good | 1.71 |
| 3 | c | A | good | good | 1.67 |
| 4 | e | A | good | good | 1.65 |
| 5 | c | B | good | good | 1.60 |
| 6 | d | B | good | good | 1.65 |
| 7 | e | B | good | good | 1.62 |
| 8 | f | B | good | good | 1.64 |
| 9 | g | B | good | good | 1.63 |

TABLE 4

| | Transfer Sheet | Acceptor Sheet | Travelling Property | Image Quality | Recording Density (magenta) |
|---|---|---|---|---|---|
| Example: | | | | | |
| 10 | h | B | good | good | 1.60 |
| 11 | i | B | good | good | 1.59 |
| Comparative Example: | | | | | |
| 6 | k | B | poor (stick-slip at a portion of a high density) | poor | 1.67 |
| Example: | | | | | |
| 12 | k' | B | good | good | 1.66 |
| 13 | c | C | good | good | 1.63 |
| 14 | f | C | good | good | 1.63 |
| 15 | c | D | good | excellent | 1.62 |
| 16 | f | D | good | excellent | 1.63 |
| 17* | a | B | good | good | 1.65 |

*Example 17 shows a case where a silicone oil was applied onto the dye carrier sheet prior to printing as shown in FIG. 6.

As will be seen from the above results, when the slippage means are provided between the transfer sheet and the dye acceptor sheet, stable thermal transfer printing operations are ensured while the sheets are passed at different relative speeds. In addition, the half-tone image does rarely deteriorate and the saturation color density does not lower even when the relative speed of the transfer sheet is $\frac{1}{3}$ of the relative speed of the dye acceptor sheet.

EXAMPLE 18

Five parts by volume of sublimable dyes of the formulas II, III and IV, 5 parts by volume of a polycarbonate, 100 parts by volume of dichloromethane and different amounts of melamine resin particles were, respectively, agitated in separate ball mills. The resulting paints were successively applied onto a polyimide film by means of a wire bar each in a thickness of about 1 micrometer to obtain a tricolor transfer sheet. The dyes of the formulas II, III and IV were, respectively, cyan, magenta and yellow in color.

II

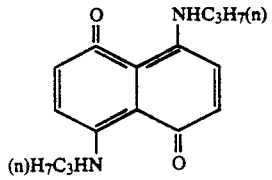

III

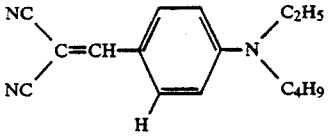

IV

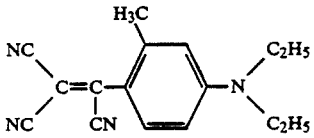

A dye acceptor sheet used was dye acceptor sheet D used in the foregoing examples.

The transfer sheet and the dye acceptor sheet were used for printing under the same conditions as indicated in the foregoing examples but the running direction of the transfer sheet was opposite to the direction of the dye acceptor sheet and the relative speed of the transfer sheet was 1/6 of the relative speed of the dye acceptor sheet. The resulting full color copy had a half-tone and an image quality similar to a color photograph.

EXAMPLE 19

An ink of the following solid composition was dissolved and dispersed. The ink was applied onto a polyimide-base transfer substrate in an amount of not less than 1 g/m$^2$ as the dye by means of a wire bar to form a dye carrier layer. The resulting transfer sheet was provided as transfer sheet F.

| Ink composition | |
|---|---|
| polycarbonate | 4 parts by weight |
| dye I | 2 |
| fluorocarbon resin (average size: 4.7 micrometers) | 4 |

The dye carrier layer was dissolved in dichloromethane and subjected to spectral absorption measurement to quantitatively determine a concentration of the dye. The amount of the dye was found to be 1.2 g/m$^2$.

Dye acceptor sheet D used in the foregoing examples was provided. The transfer sheet F and the dye acceptor sheet D were used for printing under the same conditions as used in the foregoing examples. The transfer sheet was fed in the same direction as the dye acceptor sheet at relative speeds of 1/n (where n = 1, 3, 6 and 12) of a relative speed of the dye acceptor sheet.

The relation between the recording pulse width and the recording density of magenta for different values of n is shown in FIG. 14. As will be seen from the figure, the printing system of this example had almost the same half-tone reproducibility over a range of n of from 1 to 12, without involving lowerings of saturation and half-tone recording densities. In addition, the homogenity of dots in a half-tone image does not change over a range of n=1 to n=12.

In the foregoing examples, the thermal head is used for printing, but a laser beam is likewise used. In addition, if resistor layers are formed on the dye transfer sheet or conductive materials are dispersed in the dye transfer sheet, electric energization may be used for the printing.

What is claimed is:

1. A thermal printing system, comprising (a) a dye transfer sheet having a thin substrate and a dye carrier layer formed on the substrate, said dye carrier layer comprising a mixture of at least one sublimable dye and a binder, and (b) a dye acceptor sheet having a substrate and a dye-receiving layer formed on the substrate, the dye-receiving layer being capable of receiving the sublimable dye which sublimates on heating of the dye transfer sheet, the dye carrier layer and the dye-receiving layer being arranged to face one another with a slippage means therebetween during a thermal transfer printing process in which the dye transfer sheet is fed to a thermal printing means at a speed lower than the speed at which the dye acceptor sheet is fed to the thermal printing means, said slippage means comprising a lubricating layer formed on the dye-receiving layer, said lubricating layer being made of a composition comprising a cured resin and a liquid lubricant, whereby when the dye carrier layer is heated in an imagewise pattern, the sublimable dye sublimates from the dye carrier layer and deposits on the dye-receiving layer according to the imagewise pattern without sticking of the dye transfer sheet and the dye acceptor sheet.

2. A thermal printing system according to claim 1, wherein said lubricating layer is made of a composition comprising a cured resin and a liquid lubricant in an amount of from 0.01 to 20 wt% of the cured resin.

* * * * *